US011493053B2

(12) United States Patent
Radcliffe et al.

(10) Patent No.: US 11,493,053 B2
(45) Date of Patent: Nov. 8, 2022

(54) PUMP FOR CONVEYING A FLUID

(71) Applicant: Sulzer Management AG, Winterthur (CH)

(72) Inventors: Christopher David Radcliffe, West Yorkshire (GB); Torsten Johne, Aadorf (CH); Heike Tischler, Winterthur (CH); Flavio Giardino, Otelfingen (CH); Thomas Welschinger, Radolfzell (DE)

(73) Assignee: SULZER MANAGEMENT AG, Winterthur (CH)

( * ) Notice: Subject to any disclaimer, the term of this patent is extended or adjusted under 35 U.S.C. 154(b) by 50 days.

(21) Appl. No.: 17/016,661

(22) Filed: Sep. 10, 2020

(65) Prior Publication Data

US 2021/0088056 A1 Mar. 25, 2021

(30) Foreign Application Priority Data

Sep. 24, 2019 (EP) ..... 19199356

(51) Int. Cl.
*F04D 29/16* (2006.01)
*F04D 29/043* (2006.01)
(Continued)

(52) U.S. Cl.
CPC ..... *F04D 29/167* (2013.01); *F04D 29/043* (2013.01); *F04D 1/006* (2013.01); *F04D 1/06* (2013.01)

(58) Field of Classification Search
CPC ..... F04D 1/006; F04D 29/167; F04D 29/669
See application file for complete search history.

(56) References Cited

U.S. PATENT DOCUMENTS 2,851,289 A * 9/1958 Pedersen ..... F04D 29/167 415/197
4,976,444 A * 12/1990 Richards ..... F16J 15/443 277/944

(Continued)

FOREIGN PATENT DOCUMENTS

CN 109611374 A 4/2019
WO 2014060343 A1 4/2014

OTHER PUBLICATIONS

Extended European Search Report dated Mar. 19, 2020 in corresponding European Patent Application No. 19199356.7, filed Sep. 24, 2019.

*Primary Examiner* — Richard A Edgar
*Assistant Examiner* — Jason G Davis
(74) *Attorney, Agent, or Firm* — Global IP Counselors, LLP

(57) ABSTRACT

A pump for conveying a fluid includes a stationary housing, an impeller conveying the fluid from a low pressure region to a high pressure region, a shaft to rotate the impeller about an axial direction, and a separation device to restrict a flow of the fluid from the high pressure region to the low pressure region. The separation device includes a rotary part connected to the shaft, and a stationary part stationary with respect to the housing. The rotary and stationary parts face each other and delimit a gap between the stationary part and the rotary part. The gap is arranged between the high and low pressure regions. A recess is disposed in the stationary part or the rotary part, the recess including a bottom, and a non-metallic insert is disposed in the recess. A relief channel enables fluid communication between the bottom and the low pressure region.

15 Claims, 3 Drawing Sheets

(51) Int. Cl.
*F04D 1/00* (2006.01)
*F04D 1/06* (2006.01)

(56) References Cited

U.S. PATENT DOCUMENTS 5,873,697 A 2/1999 Gully
7,125,018 B2 * 10/2006 Busse ..... F16J 15/164
277/351

* cited by examiner

PUMP FOR CONVEYING A FLUID

CROSS-REFERENCE TO RELATED APPLICATION

This application claims priority to European Patent Application No. 19199356.7, filed Sep. 24, 2019, the contents of which are hereby incorporated herein by reference in their entirety.

BACKGROUND

Field of the Invention

The invention relates to a pump for conveying a fluid.

Background Information

Conventional pumps for conveying a fluid, for example a liquid such as water, are used in many different industries. Examples are the oil and gas industry, the power generation industry, the chemical industry, the water industry or the pulp and paper industry. Such pumps are often configured as centrifugal pumps having at least one impeller and a shaft for rotating the impeller. The at least one impeller may be configured for example as a radial impeller or as an axial or semi-axial impeller or as a helicoaxial impeller. Furthermore, the impeller may be configured as an open impeller or as a closed impeller, where a shroud is provided on the impeller, the shroud at least partially covering the vanes of the impeller.

SUMMARY

It has been discovered that in such conventional pumps there may exist several locations where rotating parts come pretty close to non-rotating or stationary parts, for example in shaft bearings or in mechanical seals or in balancing devices such as balance drums or center bushes. Furthermore, the impeller or the shroud of the impeller typically rotates close to a stationary member, e.g. a part of the pump housing. The impeller is for example arranged in a stationary impeller opening, which is a part of the pump that is stationary with respect to the casing and adapted to receive the impeller. In the mounted state the impeller is located in the impeller opening such that there is a gap, which is also referred to as labyrinth, between the outer circumferential surface of the impeller's shroud and the inner circumferential surface of the stationary impeller opening. This gap constitutes a clearance between the rotary part and the stationary part.

During operation of the pump a back flow is generated flowing from the high pressure region, which is for a single stage pump the region near the outlet of the pump, through the side room, and through the gap between the front shroud and the stationary impeller opening back to the low pressure side of the impeller, which is for a single stage pump the region near the inlet of the pump.

This gap is required to reduce the risk that the rotary part, i.e. the impeller, physically contacts the stationary part. In order to increase the operating safety and to reduce the wear the gap is usually configured with a safety margin, meaning that the width of the gap is configured such that the risk of a physical contact between the impeller and the stationary part is minimized. On the other hand, the larger the width of the gap is the larger is the backflow from the high pressure side to the low pressure side through the side room. A larger backflow, however, reduces the efficiency of the pump.

Nowadays in many applications the most efficient use of the pump is strived for. It is desirable to have the highest possible ratio of the power, especially the hydraulic power, delivered by the pump to the power needed for driving the pump. This desire is mainly based upon an increased awareness of environment protection and a responsible dealing with the available resources as well as on the increasing costs of energy.

An increase of the efficiency of the pump can be achieved by reducing the width of the gap so that the backflow is reduced. To this end, a stationary wear ring surrounding the shroud of the impeller with an insert having good friction properties, for example polyetheretherketone (PEEK), can be provided. By this measure it is possible to reduce the width of the gap, i.e. the clearance between the rotary part and the stationary part, by up to 50% without jeopardizing the operational safety of the pump. The PEEK insert considerably reduces the risk of galling during a possible contact between the rotary and the stationary part.

Although this measure has proven to be successfully in many applications, it has been found that problems arise with respect to the insert. The insert can deform or even collapse, i.e. the insert is not dimensionally stable. This results in an excessive wear in particular of the insert and can considerably reduce the efficiency of the pump.

It is therefore an object of the invention to propose a pump for conveying a fluid, having a high efficiency without an increased wear and without a reduction in the operating safety.

The subject matter of the invention satisfying these objects is characterized by the features described herein.

Thus, according to one aspect of the invention, a pump for conveying a fluid is proposed, comprising a stationary housing, at least one impeller for conveying the fluid from a low pressure region to a high pressure region, a shaft for rotating the impeller about an axial direction, and a separation device for restricting a flow of fluid from the high pressure region to the low pressure region, wherein each impeller is mounted on the shaft, wherein the separation device comprises a rotary part connected to the shaft in a torque proof manner, and a stationary part configured to be stationary with respect to the housing, wherein the rotary part and the stationary part are configured to face each other and to delimit a gap between the stationary part and the rotary part, the gap being arranged between the high pressure region and the low pressure region, wherein the stationary part comprises an annular recess facing the rotary part, or the rotary part comprises an annular recess facing the stationary part, wherein the recess comprises a bottom, and wherein a non-metallic insert is provided in the recess. A relief channel is provided, and configured for a fluid communication between the bottom of the recess and the low pressure region.

Embodiments of the present invention are based on the finding, that the high pressure prevailing at that side of the separation device, which is adjacent to the high pressure chamber, tends to penetrate between the insert and the bottom of the recess. Thus, in particular in that region of the insert, which is adjacent to the low pressure side, the pressure generation between the bottom of the recess and the insert may deform the insert by pushing the insert away from the bottom of the recess. By providing the relief channel, which is configured to enable a fluid communication between the bottom of the recess and the low pressure chamber a large pressure buildup between the bottom of the recess and the insert is reliably prevented. Thus, the pressure pressing the insert towards the bottom of the recess is larger than the pressure between the insert and the bottom of the recess along the entire insert. Therefore a deformation or a collapse of the insert, in particular at the low pressure side is effectively prevented. Therefore the width of the gap between the rotary part and the stationary part, can be considerably reduced without the risk of an excessive wear and without reducing the operating safety of the pump. Reducing the width of the gap results in a considerable increase of the efficiency of the pump.

Preferably, the insert completely fills the recess, wherein the insert is fixed to the recess by means of a shrink fit.

It is a preferred measure that the relief channel ends in the recess at a location, which is closer to the high pressure chamber than to the low pressure chamber. The closer the relief channel ends to the high pressure chamber the smaller a potential pressure buildup between the bottom of the recess and the insert will be.

According to a preferred design the relief channel is configured as a bore in the stationary part or in the rotary part, respectively, because this is an easy way for manufacturing the relief channel.

Furthermore, it is preferred that the gap is configured as an annular gap, which extends in the axial direction.

According to a preferred configuration, the stationary part comprises a ring-shaped carrier surrounding the shaft, wherein the recess is disposed in the carrier.

The pump can be configured such that the impeller comprises the rotary part.

In a preferred embodiment the impeller has a front shroud, which comprises the rotary part such that the gap is delimited by the front shroud of the impeller and the insert.

In this embodiment it is advantageous, when the stationary part comprises an impeller opening having a ring-shaped carrier, which is configured to receive the front shroud of the impeller.

The pump according to the invention can be configured as a double suction pump, wherein the impeller comprises two front shrouds and wherein the stationary part comprises two ring-shaped carriers, each of which is configured to receive one of the two front shrouds of the impeller.

In other embodiments the rotary part comprises a balance drum, which is arranged on the shaft in a torque proof manner between the high pressure region and the low pressure region, wherein the stationary part is configured to delimit the gap such, that the gap extends in the axial direction along the balance drum from the high pressure region to the low pressure region.

In such embodiments the insert can be provided in a radially outer surface of the balance drum. Of course, it is also possible to provide the insert in the stationary part such that the insert faces the radially outer surface of the balance drum.

According to still other embodiments, the pump comprises a first set of impellers and a second set of impellers with the first set of impellers and the second set of impellers arranged in a back-to-back arrangement, wherein the rotary part comprises a center bush, which is arranged on the shaft in a torque proof manner between the first set of impellers and the second set of impellers with respect to the axial direction, and wherein the stationary part is configured to delimit the gap such, that the gap extends in the axial direction along the radially outer surface of the center bush.

Preferably the insert comprises a plastic or a reinforced carbon material or a carbon fiber material or a carbon fiber carbon composite material.

It is particularly advantageous, when the insert is made of polyetheretherketone.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION

Figure 1:
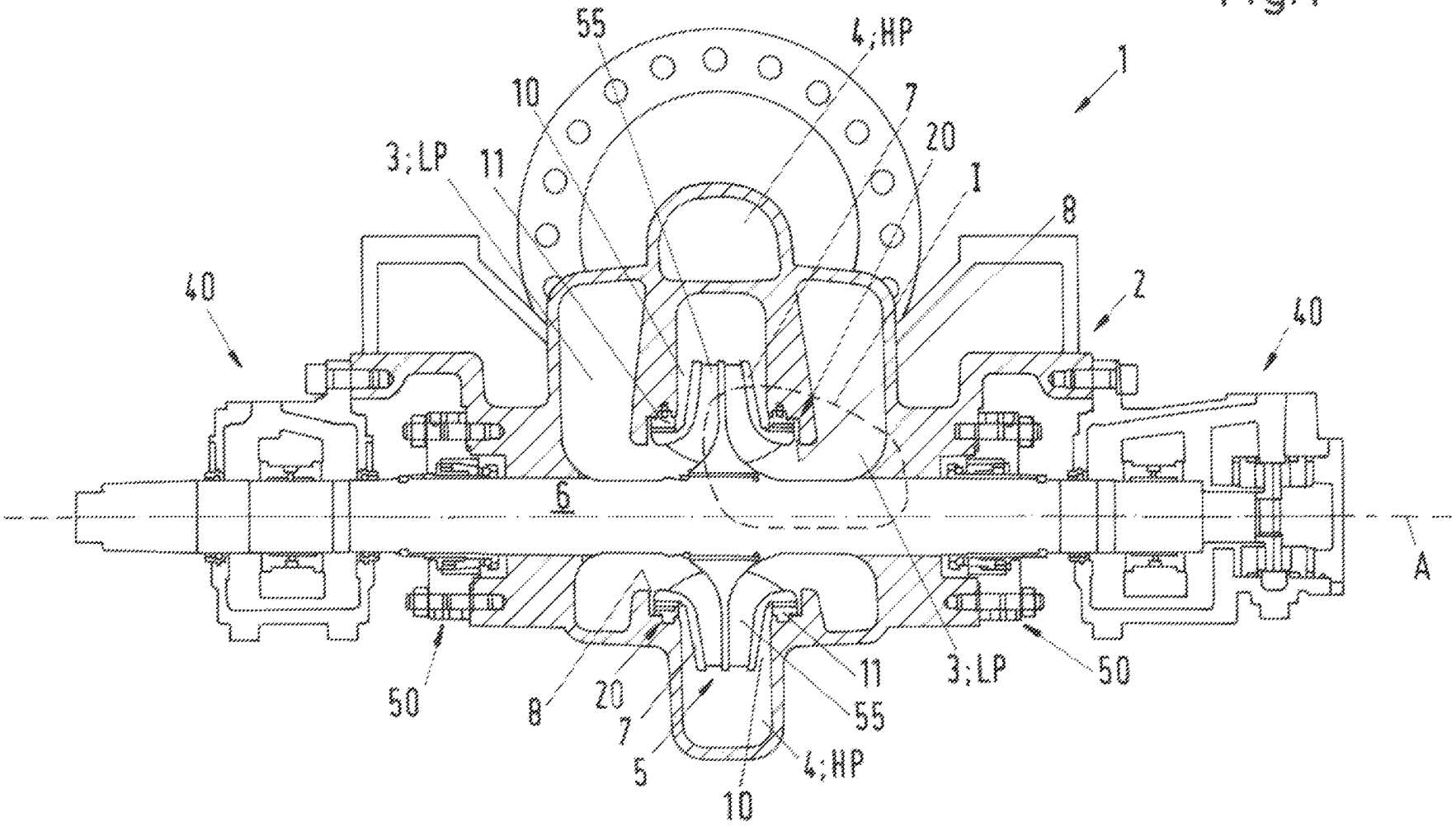
FIG. 1 is a cross-sectional view of a first embodiment of a pump according to the invention.
Figure 2:
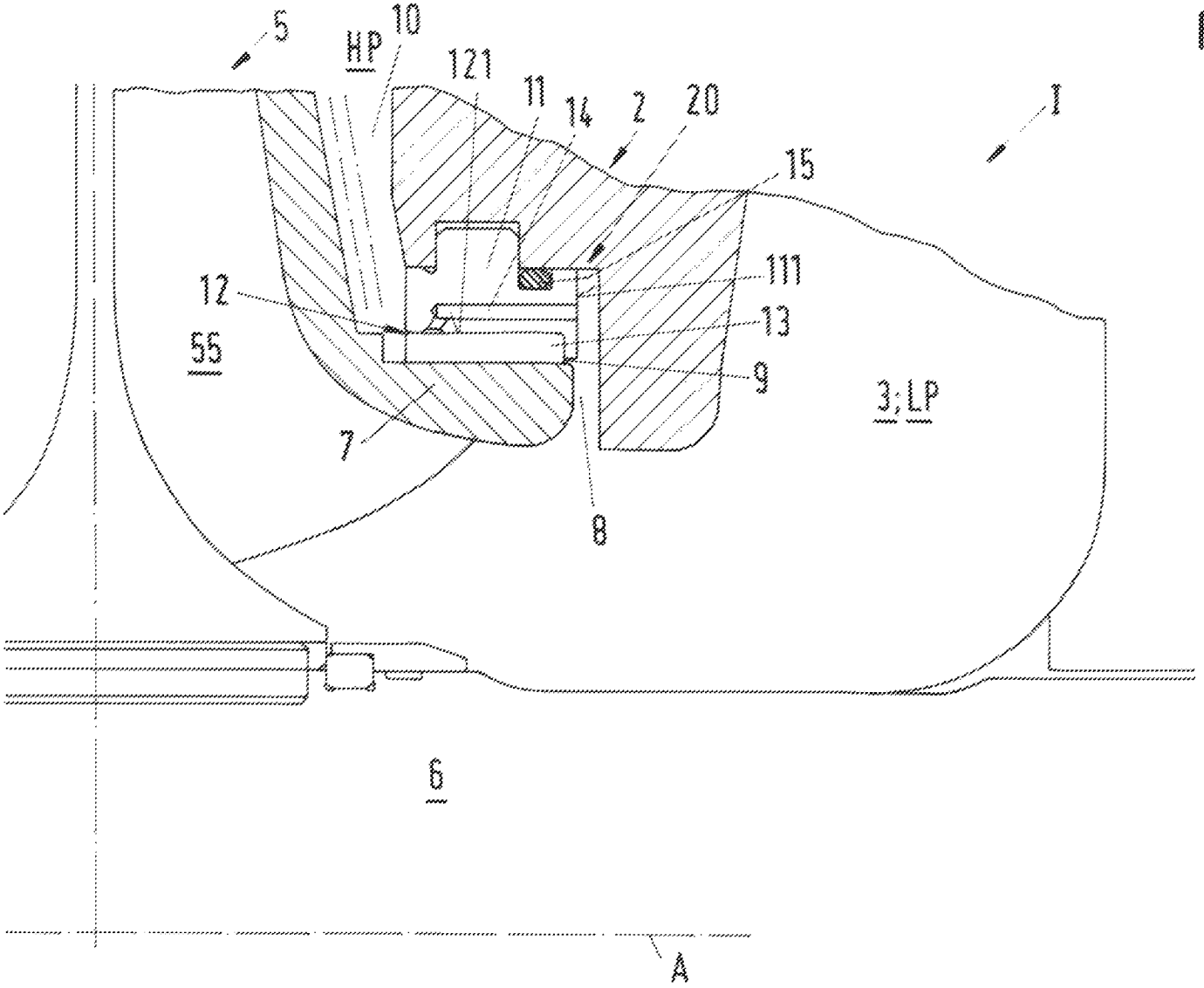
FIG. 2 is an enlarged representation of detail I in FIG. 1.

FIG. 1 shows a cross-sectional view of a first embodiment of a pump according to the invention which is designated in its entity with reference numeral 1. FIG. 2 shows an enlarged representation of detail I in FIG. 1. The pump 1 is designed as a centrifugal pump for conveying a fluid, for example a liquid such as water.

In this first embodiment the pump 1 is designed as a double suction single stage centrifugal pump. This design is one of the preferred embodiments, which is in practice useful for many applications. Of course, the invention in not restricted to this design. A pump according to the invention can also be designed as a single suction centrifugal pump or as a multistage centrifugal pump or as any other type of centrifugal pump. Based upon the description of the embodiment shown in FIG. 1 and FIG. 2 it is no problem for the skilled person to build a pump according to the invention, that is designed as another type of pump, especially centrifugal pump, for example a single suction pump.

The double suction pump 1 comprises a stationary housing 2 with two inlets 3, and an outlet 4 for the fluid to be pumped. The pump 1 has an impeller 5 with a plurality of vanes 55 for conveying the fluid from a low pressure region LP to a high pressure region HP. Since the pump 1 is designed as a single stage pump 1, the low pressure region LP is located at the inlets 3, i.e. the low pressure is essentially the suction pressure of the pump 1, and the high pressure region HP is located downstream of the impeller 5, i.e. between the impeller 5 and the outlet 4 of the pump 1. Thus, the high pressure is essentially the discharge pressure of the pump 1. The impeller 5 is arranged on a rotatable shaft 6 for rotation around an axial direction A. The axial direction A is defined by the axis of the shaft 6 around which the impeller 5 rotates during operation. The shaft 6 is rotated by a drive unit (not shown in FIG. 1).

A direction perpendicular to the axial direction A is referred to as a radial direction.

The pump 1 further comprises sealing units 50 for sealing the shaft 6 against a leakage of the fluid and bearing units 40 for supporting the shaft 6 with respect to the axial direction A as well as with respect to the radial direction.

The two inlets 3 are arranged oppositely to each other with respect to the axial direction A. Thus, according to the representation in FIG. 1, the fluid is flowing both from the left side and from the right side in axial direction A to the impeller 5, whereas the fluid from the one inlet 3 is flowing in the opposite direction to the impeller 5 as the fluid from the other inlet 3. The impeller 5 conveys both the fluid coming from the one inlet 3 and the fluid coming from the other inlet 3 into the radial direction to the outlet 4 of the pump 1.

During operation of the pump 1 a back flow is generated from the high pressure region HP trough side rooms 10 of the impeller 5 to the low pressure region LP. It is obvious that the back flow reduces the efficiency of the pump 1. Therefore a separation device 20 for restricting the back flow of the fluid is provided.

Generally speaking the separation device 20 comprises a rotary part connected to the shaft 6 in a torque proof manner and a stationary part configured to be stationary with respect to the housing 2. The rotary part and the stationary part are configured to face each other and to delimit a gap 9 between the stationary part and the rotary part. The gap 9 is arranged between the high pressure region HP and the low pressure region LP.

In the first embodiment the impeller 5 is designed as a closed double suction impeller 5 with two front shrouds 7, wherein each front shroud 7 faces one of the inlets 3. Each front shroud 7 covers the vanes 55 on that side, which faces the respective inlet 3. In this first embodiment the front shrouds 7 constitute the rotary part of the separation device 20.

The housing 2 includes two stationary impeller openings 8 for receiving the front shrouds 7 of the impeller 5. Each stationary impeller opening 8 is stationary with respect to the housing 2 of the pump 1 and has a circular cross-section with a diameter that is configured for receiving the front shroud 7. Thus, each stationary impeller opening 8 surrounds one of the front shrouds 7, such that there is the gap 9 between the respective impeller opening 8 and the respective front shroud 7.

Thus, in the first embodiment the impeller opening 8 constitute the stationary part of the separation device 20.

Since it is sufficient for the understanding in the following description reference is made only to one of the pairs front shroud 7 and impeller opening 8, namely the one encircled in FIG. 1 as detail I. This detail I is shown in an enlarged representation in FIG. 2. It goes without saying that this description is also valid for the second pair of front shroud 7 and impeller opening 8, namely the one on the left side in FIG. 1.

In the mounted state the impeller 5 is arranged coaxially within the stationary impeller opening 8 such that the outer circumferential surface of the front shroud 7 faces the inner circumferential surface of the stationary impeller opening 8. Thus, the front shroud 7 and the stationary impeller opening 8 form the gap 9 between the front shroud 7 and the stationary impeller opening 8. The gap 9 can also be called a labyrinth. It has an essentially annular shape and provides a sealing action or at least a throttling action between the high pressure region HP and the low pressure region LP. The gap 9 extends in the axial direction A and has a very small width in the radial direction, so that the width cannot be recognized even in the enlarged representation of FIG. 2. The gap 9 or the labyrinth 9 seals the side room 10 located next to the high pressure region HP against the low pressure region LP, which is located at the inlet 3. The side room 10 is located at the high pressure side of the impeller 5 near the outlet 4 of the pump 1 and delimited by the front shroud 7 of the impeller 5 as well as by the housing 2 of the pump 1. During operation of the pump 1 the back flow is directed from the high pressure region HP through the side room 10. The back flow passes the gap 9 or the labyrinth 9 and reaches the low pressure region LP of the impeller 5 next to the inlet 3. It is one of the functions of the gap 9 to provide some sealing action to limit the back flow. That is the reason why the gap 9 is also called a labyrinth.

In the first embodiment of the pump 1 the impeller opening 8, which constitutes the stationary part of the separation device 20, comprises a ring-shaped carrier 11 surrounding the shaft 6 wherein the carrier 11 is fixed to the wall delimiting the impeller opening 8 in such a manner that the radially inner surface of the carrier 11 faces the front shroud 7. For example, the carrier 11 is fixed to the wall of the impeller opening 8 by screws. The ring-shaped carrier 11 is also referred to as wear ring. In the radially outer surface of the ring-shaped carrier 11 a sealing element 15 can be provided for sealing between the carrier 11 and the housing 2. The sealing element 15 is for example an O-ring, which is inserted in an annular groove disposed in the radially outer surface of the carrier 11.

The carrier 11 includes an annular recess 12, which is arranged in the radially inner surface of the carrier 11. The recess comprises a bottom 121, which is the annular surface surrounding the shaft 6 and radially outwardly delimiting the recess 12.

A non-metallic insert 13 is arranged in the recess 12, wherein the insert 13 is preferably configured such, that it completely fills the recess 12 and slightly protrudes over the recess 12 with respect to the radial direction. Thus, if there were a physical contact between the rotary part and the stationary part of the separating device 20 it is only the insert 13 that physically contacts the front shroud 7. The insert 13 is preferably made of a plastic that has good frictional properties, i.e. a good resistance against wear due to friction. Of course, there are also other preferred materials for manufacturing the insert 13. For example, the insert 13 can comprise or can consist of a carbon material or a reinforced carbon material or a carbon fiber material or a carbon fiber carbon composite material.

One of the preferred materials for the insert 13 is polyetheretherketone (PEEK). The insert 13 can be fixed in the recess 12 by any means or in any manner which is known in the art. However, it is preferred that the insert 13 is fixed to the recess 12 by shrink fit.

According to the invention a relief channel 14 is provided configured for a fluid communication between the bottom 121 of the recess 12 and the low pressure region LP.

As it can be seen in FIG. 2 the relief channel 14 is designed as a bore in the carrier 11, which bore extends from the bottom 121 of the recess 12 through the carrier 11 to a surfaces 111 of the carrier 11, which is facing the low pressure region LP. The relief channel 14 is configured as a bore extending from the surface 111 in the axial direction A, i.e. parallel to the recess 12, which bore is connected to the bottom 121 of the recess 12 by a slant drill hole.

During operation of the pump 1 the relief channel 14 reliably prevents a pressure build up between the bottom 121 of the recess 12 and the surface of the insert 13 abutting against the bottom 121 of the recess 12. In case the high pressure were to penetrate between the insert 13 and the bottom 121 of the recess 12, a pressure buildup is prevented because the pressure is reliably relieved by the relief channel 14. Therefore the pressure prevailing at the bottom 121 of the recess 12 is essentially the low pressure prevailing in the low pressure region LP. The pressure drop over the separation device 20 takes place only over the gap 9, meaning that the pressure in the gap 9 is always larger than the pressure at the bottom 121 of the recess 12. Therefore the insert 13 is always pressed against the bottom 121 of the recess 12 and cannot deform or collapse into the gap 9.

Preferably, the relief channel 14 ends in the recess 12 at a location which is closer to the high pressure region HP than to the low pressure region LP, so that any fluid coming from the high pressure region HP and penetrating between the insert 13 and the recess 12 is immediately discharged to the low pressure region LP.

In other embodiments it is the rotary part that comprises the recess with the insert. In an analogous manner the relief channel is disposed in the rotary part, configured for a fluid communication between the bottom of the recess in the rotary part and the low pressure region LP.

Figure 3:
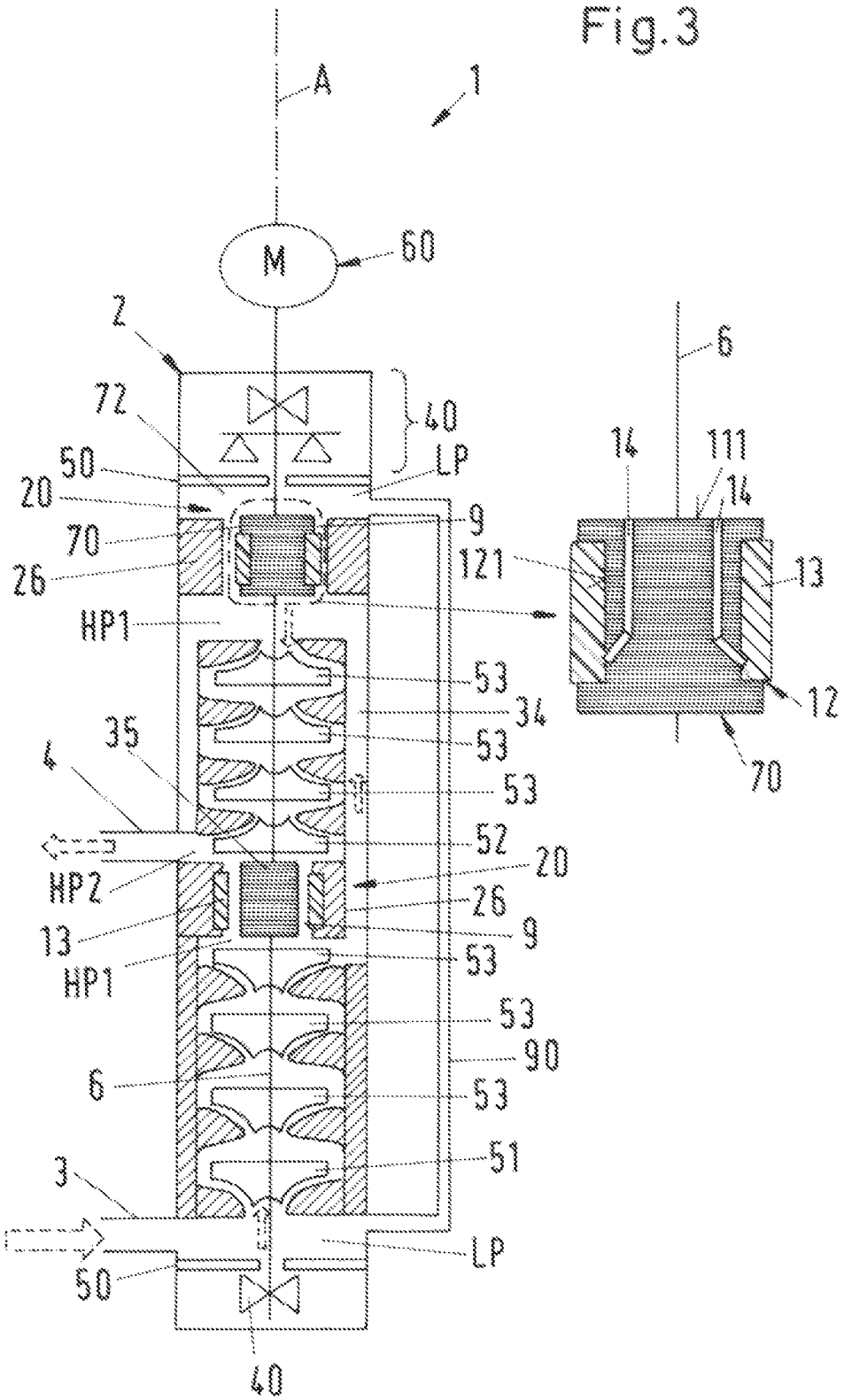
FIG. 3 is a schematic cross-sectional view of a second embodiment of a pump according to the invention.

FIG. 3 shows a schematic cross-sectional view of a second embodiment of a pump 1 according to the invention.

In the following description of the second embodiment of the pump 1 only the differences to the first embodiment are explained in more detail. The explanations with respect to the first embodiment are also valid in the same way or in analogously the same way for the second embodiment. Same reference numerals designate the same features that have been explained with reference to the first embodiment or functionally equivalent features.

The second embodiment of the pump according to the invention is configured as a multistage centrifugal pump 1. The shaft 6 is driven to rotate about the axial direction A by a drive unit 60, which comprises e.g. an electric motor. In other embodiments the drive unit 60 can also be arranged within the housing 2 of the pump 1.

The housing 2 of the pump 1 comprises only one inlet 3 through which the fluid enters the pump 1. Furthermore, the housing 2 comprises the outlet 4 for discharging the fluid with an increased pressure as compared to the pressure of the fluid at the inlet 3.

The multistage pump 1 comprises a plurality of impellers 5 with a first stage impeller 51, a last stage impeller 52 and optionally a number of intermediate stage impellers 53. As an example the multistage pump 1 is an eight stage pump having the first stage impeller 51, the last stage impeller 52 and six intermediate stage impellers 53, which are all arranged in series on the pump shaft 6. Of course, the number of eight stages is only exemplary. In other embodiments the multistage pump 1 can comprise more than eight stages, e.g. ten or twelve stages, or less than eight stages for example four or two stages.

The first stage impeller 51 is the first impeller when viewed in the direction of the streaming fluid, i.e. the first stage impeller 51 is located next to the inlet 3 and facing the low pressure region LP. The last stage impeller 52 is the last impeller 5 when viewed in the direction of the streaming fluid, i.e. the last stage impeller 52 is located next to the outlet 4 and facing a second high pressure region HP2, in which prevails essentially the discharge pressure of the pump 1. The second high pressure region HP2 of the second embodiment corresponds to the high pressure region HP of the first embodiment.

Each impeller 51, 52, 53 is fixedly mounted on the shaft 6 in a torque proof manner. The plurality of impellers 51, 52, 53 is arranged in series on the shaft and configured for increasing the pressure of the fluid from the low pressure region LP to the second high pressure region HP2.

The drive unit 60 is configured to exert a torque on the shaft 6 for driving the rotation of the pump shaft 6 and the impellers 51, 52, 53 about the axial direction A.

The multistage pump 1 can be configured as a vertical pump 1, meaning that during operation the shaft 6 is extending in the vertical direction, which is the direction of gravity. Thus, the axial direction A coincides with the vertical direction.

In other embodiments the multistage pump can be configured as a horizontal pump, meaning that during operation the shaft is extending horizontally, i.e. the axial direction A is perpendicular to the direction of gravity.

As can be seen in FIG. 3 the plurality of impellers 51, 52, 53 comprises a first set of impellers 51, 53 and a second set of impellers 52, 53, wherein the first set of impellers 51, 53 and the second set of impellers 52, 53 are arranged in a back-to-back arrangement. The first set of impellers 51, 53 comprises the first stage impeller 51 and the three intermediate impellers 53 of the next three stages and the second set of impellers 52, 53 comprises the last stage impeller 52 and the three intermediate impellers 53 of the three preceding stages. In other embodiments the first set of impellers can comprise a different number of impellers than the second set of impellers.

In a back-to-back arrangement the first set of impellers 51, 53 and the second set of impellers 52, 33 are arranged such that the axial thrust generated by the action of the rotating first set of impellers 51, 53 is directed in the opposite direction as the axial thrust generated by the action of the rotating second set of impellers 52, 53. As indicated in FIG. 3 by the dashed arrows without reference numeral, the fluid enters the multistage pump 1 through the inlet 3 located at the lower end of the housing 2, passes the stages one (first stage), two, three and four, is then guided through a crossover line 34 to the suction side of the fifth stage impeller 53 at the upper end of the pump 1, passes the stages five, six, seven and eight (last stage), and is then discharged through the outlet 4, which is arranged between the upper end and the lower end of the pump 1.

Regarding multistage pumps, the back-to-back arrangement is preferred for many applications because the axial thrust acting on the shaft 6, which is generated by the first set of impellers 51, 53 counteracts the axial thrust, which is generated by the second set of impellers 52, 53. Thus, the two axial thrusts compensate each other at least partially.

Neglecting the pressure drop over the crossover line 34 the fourth stage discharge pressure prevailing downstream of the fourth stage impeller 53 and in the crossover line 34 is essentially the same as the pressure at the suction side of the fifth stage impeller. This pressure is referred to as a first high pressure, which is higher than the suction pressure in the low pressure region LP and smaller than the discharge pressure in the second high pressure region HP2. The region, where this first high pressure prevails is referred to as first high pressure region HP1. Thus, with respect to the second high pressure region HP2 the first high pressure region HP1 is a low pressure region, and with respect to the low pressure region LP the first high pressure region HP1 is a high pressure region.

Therefore the multistage pump 1 can comprise two separation devices 20, namely a separation device 20 for restricting the flow of fluid from the second high pressure region HP2 to the first high pressure region HP1, and another separation device 20 for restricting the flow of fluid from the first high pressure region HP1 to the low pressure region LP. Both the separation devices 20 can be configured in an analogous manner as the separation device 20, which has been explained referring to the first embodiment of the pump 1.

One of the separation devices 20 delimits the flow of fluid from the first high pressure region HP1 to the low pressure region LP. The rotary part of the separation device 20 comprises a balance drum 70 (also referred to as throttle bush), which is arranged on the shaft 6 in a torque proof manner between the first high pressure region HP1 and a backside 72, which is connected by a balance line 90 to the low pressure region LP at the inlet 3 in a manner, which is as such known in the art. Neglecting the pressure drop over the balance line 90, the backside 72 belongs to the low pressure region LP.

The balance drum 70 is surrounded by the stationary part 26 of the separation device 20, so that the gap 9 is formed between the radially outer surface of the balance drum 70 and the stationary part 26. The stationary part 26 is configured to be stationary with respect to the housing 2. The gap 9 is an annular gap between the radially outer surface of the balance drum 70 and the stationary part 26. The stationary part 26 is configured to limit the gap 9 such, that the gap 9 extends in the axial direction A along the balance drum 70 from the first high pressure region HP1 to the low pressure region LP at the backside 72.

The balance line 90 is configured for recirculating the fluid from the backside 72 of the balance drum 70 to the low pressure side at the inlet 3. During operation, a part of the pressurized fluid exiting the crossover line 34 flows through the gap 9 to the backside 72, enters the balance line 90 and is recirculated to the low pressure region LP at the inlet 3.

The other one of the separation devices 20 delimits the flow of fluid from the second high pressure region HP2 to the first high pressure region HP1 at the discharge side of the fourth stage impeller 53, where the crossover line 34 starts. The rotary part of the separation device 20 comprises a center bush 35, which is arranged on the shaft 6 in a torque proof manner between the first set of impellers 51, 53 and the second set of impeller 52, 53 with respect to the axial direction A. The stationary part 26 is configured to delimit the gap 9 such, that the gap 9 extends in axial direction along the radially outer surface of the center bush 35.

The center bush 35, too, is a balancing device for reducing the overall axial thrust acting on the shaft 6. The center bush 35 rotates with the shaft 6. The center bush 35 is arranged on the shaft 6 between the last stage impeller 52, which is the last impeller of the second set of impellers, and the intermediate impeller 53 of the fourth stage, which is the last impeller of the first set of impellers, when viewed in the direction of increasing pressure, respectively. The center bush 35 is surrounded by the stationary part 26 being stationary with respect to the housing 2. The gap 9 is formed as an annular balancing passage between the radially outer surface of the center bush 35 and the stationary part 26.

The function of the center bush 35 and the gap 9 is in principle the same as the function of the balance drum 70 and the gap 9. At the axial surface of the center bush 35 facing the last stage impeller 52 the high pressure of the second high pressure region HP2 prevails, and at the other axial surface facing the intermediate impeller 53 of the fourth stage a lower pressure prevails, namely the pressure of the first high pressure region HP1. Therefore the fluid can pass from the last stage impeller 52 through the gap 9 along the center bush 35 to the intermediate impeller 53 of the fourth stage.

In other embodiments there is only a separation device 20 comprising a balance drum 70 but no separating device comprising a center bush 35. In still other embodiments there is only a separation device 20 comprising a center bush 35 but no separating device comprising a balance drum 70. In addition, there are also embodiments comprising two or even more separating devices 20, each of which comprises a balance drum 70.

Both the separating device 20 comprising the balance drum 70 and the separating device 20 comprising the center bush 35 can be configured in accordance with the invention, namely comprising the relief channel 14, configured for a fluid communication between the bottom 121 of the recess 12 and the low pressure region LP or HP1, respectively.

Both with respect to the separating device 20 having the balance drum 70 and with respect to the separating device 20 having the center bush 35 it is possible to provide the recess 12 for receiving the insert 13 in the rotary part of the separating device 20 or in the stationary part of the separating device 20. In the embodiment shown in FIG. 3 the separating device 20 with the balance drum 70 has the recess 12 with the insert 13 in the rotating part, i.e. in the balance drum 70. The separating device 20 with the center bush 35 has the recess 12 with the insert 13 in the stationary part 26.

In each case the relief channel 14 can be configured in an analogous manner as it has been explained with respect to the first embodiment of the pump 1. For a better understanding FIG. 3 additionally shows an enlarged view of the balance drum 70 with the insert 13 arranged in the recess 12 with the insert 13 protruding over the balance drum 70 with respect to the radial direction. The relief channel 14 is designed as a bore connecting the bottom 121 of the recess 12 with the backside 72 belonging to the low pressure region LP. As an option and as shown in the enlarged representation of the balance drum 70 there can be a plurality of relief channels 14, for example two, three or four relief channels 14, each of which extends from the bottom 121 of the recess 12 to the surface 111. Which delimits the balance drum with respect to the axial direction A, and which faces the low pressure region LP.

The relief channel(s) 14 in the stationary part 26 facing the center bush 35 can be configured in an analogous manner, i.e. as a bore connecting the bottom 121 of the recess 12 in the stationary part 26 with the low pressure region HP1, which is in this case the region at the discharge side of the fourth stage impeller 53.

What is claimed:

1. A pump for conveying a fluid, comprising:

a stationary housing;

at least one impeller configured to convey the fluid from a low pressure region to a high pressure region;

a shaft configured to rotate the impeller about an axial direction; and a separation device configured to restrict a flow of the fluid from the high pressure region to the low pressure region, the at least one impeller being mounted on the shaft, the separation device comprising a rotary part connected to the shaft in a torque proof manner, and a stationary part configured to be stationary with respect to the housing, the rotary part and the stationary part configured to face each other and to delimit a gap between the stationary part and the rotary part, the gap being arranged between the high pressure region and the low pressure region, an annular recess is disposed in at least one of the stationary part facing the rotary part, or the rotary part facing the stationary part, the recess comprising a bottom, and a non-metallic insert is disposed in the recess, and a relief channel is provided and configured to enable fluid communication between the bottom of the recess and the low pressure region, the relief channel being a bore extending from a surface in the axial direction, and connected to the bottom of the recess by a slant drill hole.

2. The pump in accordance with claim 1, wherein the insert completely fills the recess and the insert is fixed to the recess by shrink fit.

3. The pump in accordance with claim 1, wherein the relief channel ends in the recess at a location which is closer to the high pressure region than to the low pressure region.

4. The pump in accordance with claim 1, wherein the relief channel is a bore in the stationary part or in the rotary part.

5. The pump in accordance with claim 1, wherein the gap is an annular gap, which extends in an axial direction.

6. The pump in accordance with claim 1, wherein the stationary part comprises a ring-shaped carrier surrounding the shaft, and the recess is provided in the carrier.

7. The pump in accordance with claim 1, wherein the impeller comprises the rotary part.

8. The pump in accordance with claim 7, wherein the impeller has a front shroud, which comprises the rotary part such that the gap is delimited by the front shroud of the impeller and the insert.

9. The pump in accordance with claim 8, wherein the stationary part comprises an impeller opening having a ring-shaped carrier, which is configured to receive the front shroud of the impeller.

10. The pump in accordance with claim 1, wherein the pump is a double suction pump, the impeller comprises two front shrouds and the stationary part comprises two ring-shaped carriers, each of which is configured to receive one of the two front shrouds of the impeller.

11. The pump in accordance with claim 1, wherein the rotary part comprises a balance drum, which is arranged on the shaft in a torque proof manner between the high pressure region and the low pressure region and the stationary part is configured to delimit the gap such, that the gap extends in an axial direction along the balance drum from the high pressure region to the low pressure region.

12. The pump in accordance with claim 11, wherein the insert is provided in a radial outer surface of the balance drum.

13. The pump in accordance with claim 1, wherein the at least one impeller includes a first set of impellers and a second set of impellers with the first set of impellers and the second set of impellers arranged in a back-to-back arrangement, the rotary part comprises a center bush, which is arranged on the shaft in a torque proof manner between the first set of impellers and the second set of impellers with respect to an axial direction, and the stationary part is configured to delimit the gap such, that the gap extends in the axial direction along a radial outer surface of the center bush.

14. The pump in accordance with claim 1, wherein the insert comprises a plastic or a reinforced carbon material or a carbon fiber material or a carbon fiber carbon composite material.

15. The pump in accordance with claim 1 wherein the insert is polyetheretherketone.

* * * * *